US008419436B2

(12) United States Patent
Perez

(10) Patent No.: US 8,419,436 B2
(45) Date of Patent: Apr. 16, 2013

(54) BOXING PUNCHING COMBINATION TRAINING/WORKOUT SYSTEM

(76) Inventor: Reynaldo Ronnie Perez, Austin, TX (US)

( * ) Notice: Subject to any disclaimer, the term of this patent is extended or adjusted under 35 U.S.C. 154(b) by 380 days.

(21) Appl. No.: 12/655,619

(22) Filed: Jan. 4, 2010

(65) Prior Publication Data

US 2010/0184010 A1 Jul. 22, 2010

Related U.S. Application Data

(60) Provisional application No. 61/204,387, filed on Jan. 6, 2009.

(51) Int. Cl.
*A63B 69/00* (2006.01)

(52) U.S. Cl.
USPC ..... 434/247

(58) Field of Classification Search ..... 434/247, 434/250, 257, 258; 482/83, 84, 86, 87, 89, 482/90; D21/787
See application file for complete search history.

(56) References Cited

U.S. PATENT DOCUMENTS

| | | | | | |
|---|---|---|---|---|---|
| 233,482 | A * | 10/1880 | DeLong | 283/117 |
| 2,158,475 | A * | 5/1939 | Montine | 434/250 |
| 4,088,315 | A * | 5/1978 | Schemmel | 482/4 |
| 4,401,303 | A * | 8/1983 | Anderson et al. | 482/4 |
| 5,156,409 | A * | 10/1992 | Barnes | 273/444 |
| 5,281,191 | A * | 1/1994 | DeSousa | 482/83 |
| D384,378 | S * | 9/1997 | Sigler | D21/787 |
| D498,792 | S * | 11/2004 | Toniolo | D19/59 |
| 7,678,029 | B2 * | 3/2010 | Ng | 482/90 |
| 7,887,467 | B2 * | 2/2011 | Booker | 482/83 |
| 7,909,749 | B2 * | 3/2011 | Sheedy | 482/148 |
| 2007/0099772 | A1 * | 5/2007 | Fu et al. | 482/83 |
| 2009/0191528 | A1 * | 7/2009 | Davey | 434/258 |

* cited by examiner

*Primary Examiner* — Kurt Fernstrom

(57) ABSTRACT

My boxing punching combination system is the idea of identifying specific numbers to represent specific punches and having them placed at the proper location for those punches. By placing these numbers appropriately on any given apparatus, any user can easily execute boxing punching combinations regardless of the user's level of experience in boxing.

11 Claims, 3 Drawing Sheets

Figure 1:
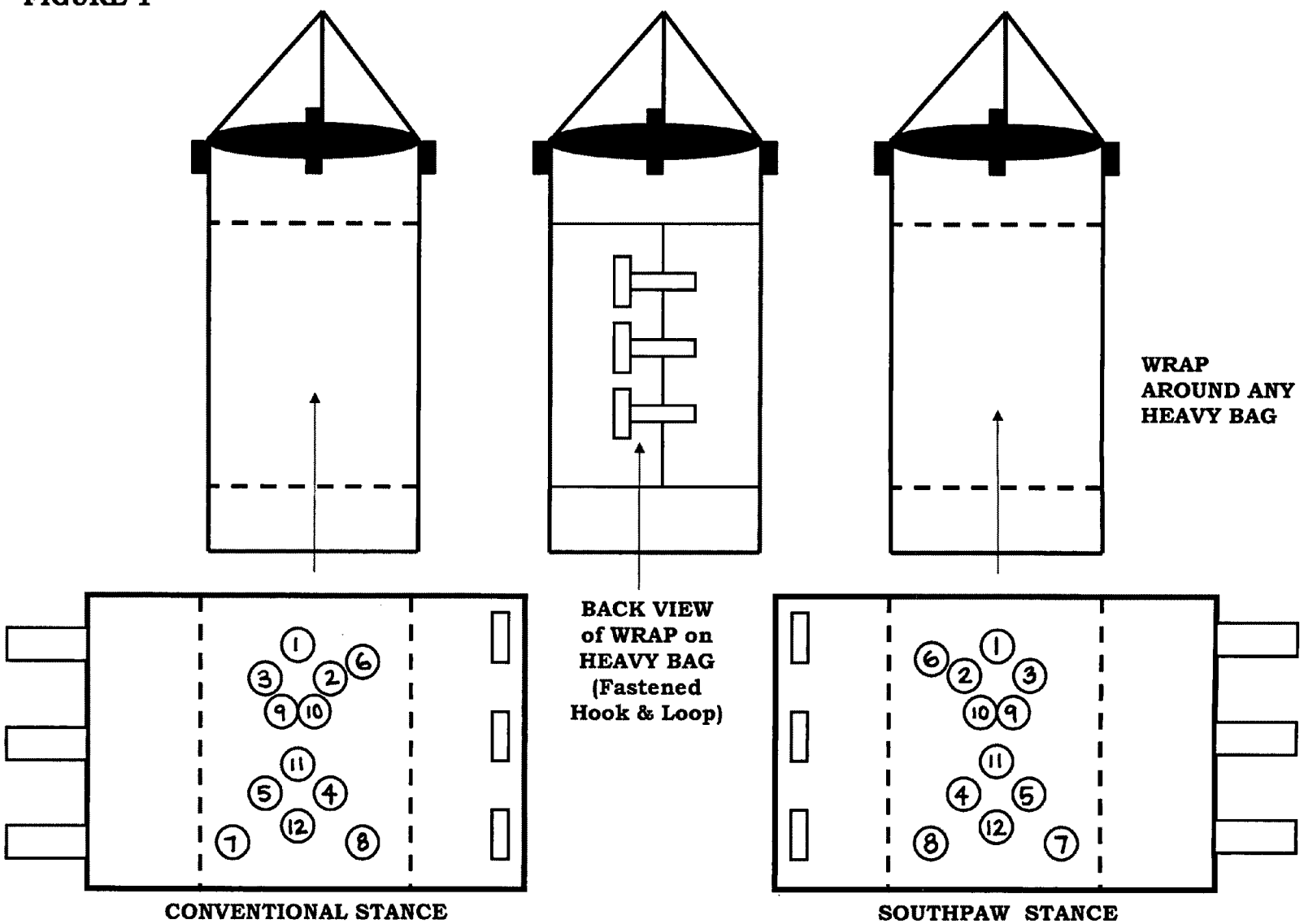

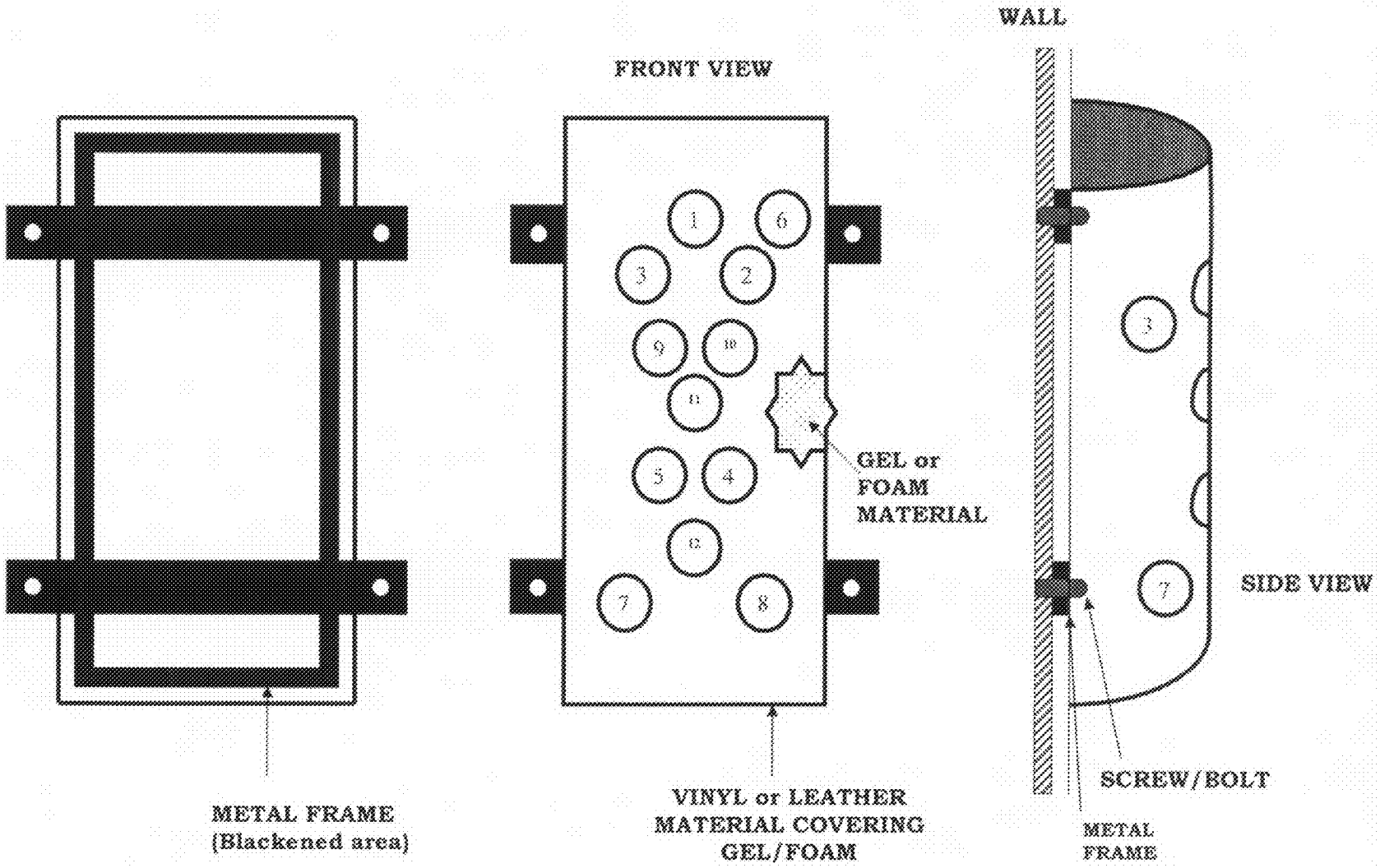
FIGURE 2 Wall Mountable Punching System

FIGURE 3 Punching Bag Wrap
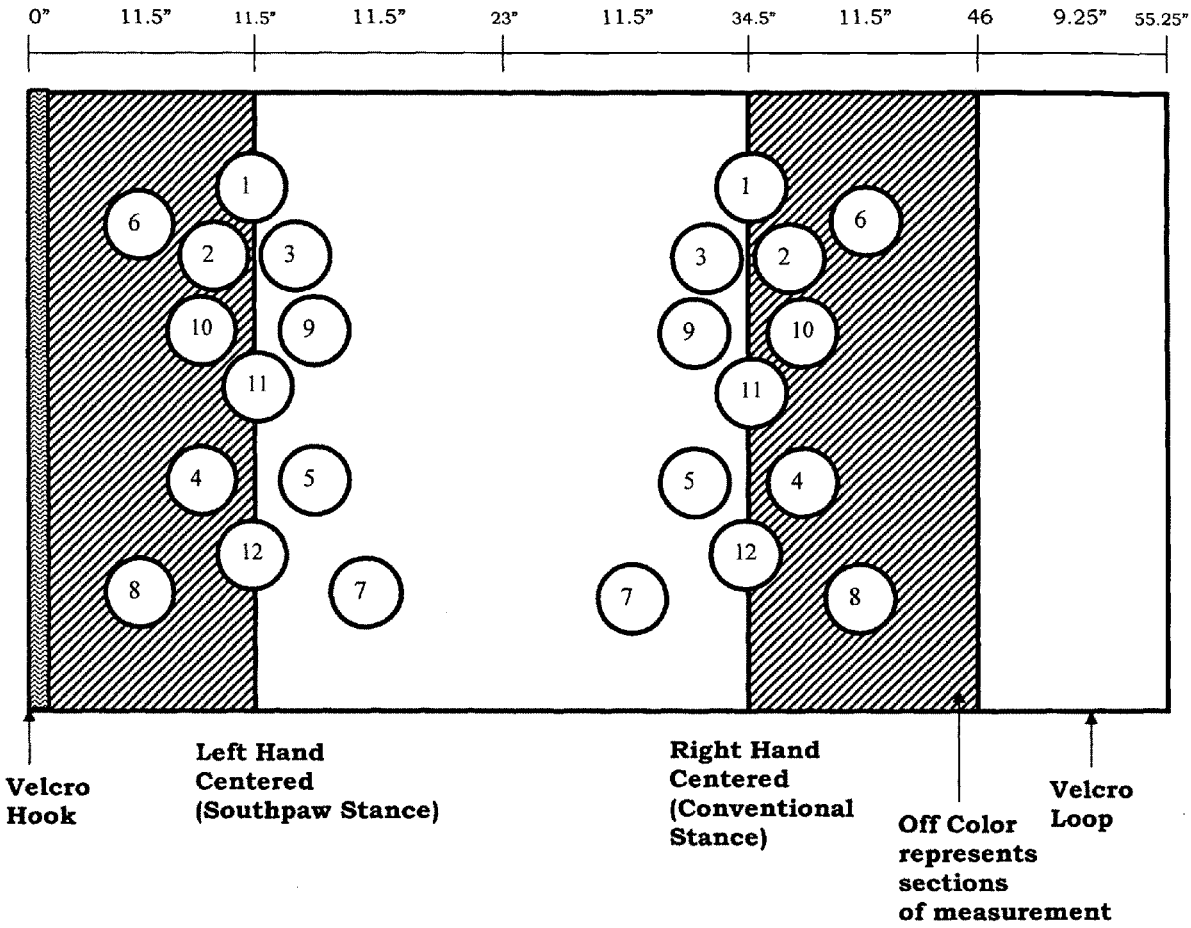
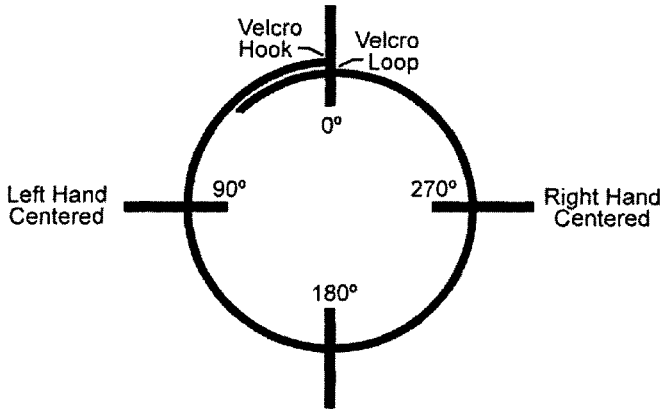

BOXING PUNCHING COMBINATION TRAINING/WORKOUT SYSTEM

CROSS-REFERENCE TO RELATED APPLICATION

Application No. 61/204,387 filed Jan. 6, 2009

FEDERALLY SPONSORED RESEARCH

Not Applicable

SEQUENCE LISTING OR PROGRAM

Not Applicable

BACKGROUND OF THE INVENTION

I have invented a boxing punching system that is portable and removable that will simulate actual punching combos on a heavy bag used today in the sport of boxing. It is designed for all levels from beginner to professional boxers. It is a simplified, easy to use system that utilizes a numbering system to correlate to boxing punches that have been used throughout the history of boxing and still today. My method of simulating punching combinations will allow for any person to be able to execute boxing combinations like a trained boxer. This system can also be utilized for professional boxers as means to workout and train for a fight. There is nothing currently available in the boxing world that resembles a system such as this.

My system creates muscle memory through repetition to be able to execute the punches as you see the opportunity or openings such as when mistakes are being made by your opponent.

SUMMARY

This invention utilizes a number system to represent boxing punches/combinations in a way that can be easily created and used to benefit all level of users.

DRAWINGS

FIG. 1—Illustration of number system on heavy bag

FIG. 2—Illustration of number system on a wall mountable system

FIG. 3—Illustration of punching bag wrap

DETAILED DESCRIPTION

The boxing punches will be as follows:

| Orthodox (Right Handed) Stance | SouthPaw (Left Handed) Stance |
|---|---|
| 1 = Left jab | 1 = Right Jab |
| 2 = Straight Right/Right Cross | 2 = Straight Left/Left Cross |
| 3 = Left Hook | 3 = Right Hook |
| 4 = Right Uppercut to the Body | 4 = Left Uppercut to the Body |
| 5 = Left Uppercut to the Body | 5 = Right Uppercut to the Body |
| 6 = Right Hook to the Head | 6 = Left Hook to the Head |
| 7 = Left Hook to the Body | 7 = Right Hook to the Body |
| 8 = Right Hook to the Body | 8 = Left Hook to the Body |
| 9 = Left Uppercut to the Chin | 9 = Right Uppercut to the Chin |
| 10 = Right Uppercut to the Chin | 10 = Left Uppercut to the Chin |
| 11 = Straight Right to the Chest | 11 = Straight Left to the Chest |

-continued

| Orthodox (Right Handed) Stance | SouthPaw (Left Handed) Stance |
|---|---|
| 12 = Straight Left Jab to the Mid-section | 12 = Straight Right Jab to the Mid-section |

Examples of how these numbered punches will be used in the system—these are just a few examples for the Orthodox stance. The user would throw punches to the general area of the numbers on the bag. For the Southpaw stance, the numbers on the bag would be reversed.

Example 1: 1, 2, 7
Example 2: 4, 3, 2
Example 3: 1, 1, 8
Example 4: 1, 2, 3, 4, 5, 2
Example 5: 6, 7, 2, 3, 2
Example 6: 1, 2, 3, 2
Example 7: 10, 3, 2
Example 8: 9, 2
Example 9: 1, 11, 3, 2
Example 10: 12, 2, 3, 2

My invention works as follows—The user will place the wrap securely around their existing heavy bag with the numbers facing them. This will be done by using a hook and loop system with a non-slip backing which will ensure that it can be used on a variety of heavy bags including different sizes of heavy bags. The wrap will be adjustable to the user's height without having to go through the trouble of adjusting the heavy bag itself. The wrap would be made out of a neoprene or gel material measuring from 24"-30"×44"-50".

Dimensions will change to accommodate smaller or larger than normal bags. FIG. 1 is a view of how the numbers would be placed on the neoprene or gel wrap which will cover the heavy bag. It shows the 2 different positions of numbers based on the stance of the user.

Alternatives

- Have the numbers permanently placed on a heavy bag vs a gel wrap
- Using different colors within the background behind the number—this will help especially when utilizing this system for younger kids. The background behind the number will be different colors or the shape can also vary. In addition, letters can be used in place of the numbers.
- Have an option for reversible to accommodate both stances in one wrap
- In place of the Hook & Loop, a zipper can be used to secure the numbered wrap to the existing heavy bag
- Wall mounting option, using same concept for numbers. This is an alternative option for those users who do not have the space to hang a traditional heavy bag. See FIG. 2.
- The numbers for uppercut punches will be indented inwards to allow for the punch to have a stopping point and truly mimic an uppercut punch
- Numbers can be interchangeable to allow the flexibility to change the combination sequence
- Numbers can be embroidered or screen printed on the apparatus See FIG. 3 Punching Bag Wrap w/ screen printed numbers on a wrap
- A Velcro strap can be added to the top of the heavy bag to secure the wrap and prevent it from sliding down
- The amount of numbers can be decreased or increased based on individual user's preference
- A flashing light or lights can be added to remind user to move his/her head Using LED lights within the numbers to allow to program the different combination sequences

The invention claimed is:

1. A device for training in boxing punch combinations comprising:

a wrap comprising neoprene or gel and adapted to be securely wrapped around a punching bag, wherein the wrap measures 44 to 50 inches in width and 24 to 30 inches in height and comprises screen printed numerical indicia representing the numbers one through twelve, where each number represents a specific boxing punch and is positioned on the wrap such that when the wrap is secured to a punching bag, a user can strike the number using the corresponding punch.

2. The device of claim 1, wherein the wrap is adapted to be adjustable to a user's height when securing the wrap to a punching bag.

3. The device of claim 1, wherein the wrap comprises hook and loop connectors for securing the wrap to a punching bag and a non-slip backing.

4. The device of claim 1, wherein the numerical indicia are placed on the wrap to accommodate a right handed stance, and the numbers represent punches as follows:

1=Left jab,
2=Straight Right/Right Cross,
3=Left Hook,
4=Right Uppercut to the Body,
5=Left Uppercut to the Body,
6=Right Hook to the Head,
7=Left Hook to the Body,
8=Right Hook to the Body,
9=Left Uppercut to the Chin,
10=Right Uppercut to the Chin,
11=Straight Right to the Chest,
12=Straight Left Jab to the Mid-section.

5. The device of claim 1, wherein the numerical indicia are placed on the wrap to accommodate a left handed stance, and the numbers represent punches as follows:

1=Right jab,
2=Straight Left/Left Cross,
3=Right Hook,
4=Left Uppercut to the Body,
5=Right Uppercut to the Body,
6=Left Hook to the Head,
7=Right Hook to the Body,
8=Left Hook to the Body,
9=Right Uppercut to the Chin,
10=Left Uppercut to the Chin,
11=Straight Left to the Chest,
12=Straight Right lab to the Mid-section.

6. A device for training in boxing punch combinations comprising:

a sheet comprising gel or foam and adapted to be mounted to a wall, wherein the sheet measures 44 to 50 inches in width and 24 to 30 inches in height and comprises screen printed numerical indicia representing the numbers one through twelve, where each number represents a specific boxing punch and is positioned on the sheet such that when the sheet is secured to a wall, a user can strike the number using the corresponding punch, and a wall mountable frame which is adapted to support the sheet.

7. The device of claim 6, wherein the sheet comprises a vinyl or leather material covering the gel or foam.

8. The device of claim 6, wherein the frame is metal.

9. The device of claim 6, wherein the sheet forms a half-cylinder shape when secured to the frame.

10. The device of claim 6, wherein the numerical indicia are placed on the sheet to accommodate a right handed stance, and the numbers represent punches as follows:

1=Left jab,
2=Straight Right/Right Cross,
3=Left Hook,
4=Right Uppercut to the Body,
5=Left Uppercut to the Body,
6=Right Hook to the Head,
7=Left Hook to the Body,
8=Right Hook to the Body,
9=Left Uppercut to the Chin,
10=Right Uppercut to the Chin,
11=Straight Right to the Chest,
12=Straight Left Jab to the Mid-section.

11. The device of claim 6, wherein the numerical indicia are placed on the sheet to accommodate a left handed stance, and the numbers represent punches as follows:

1=Right jab,
2=Straight Left/Left Cross,
3=Right Hook,
4=Left Uppercut to the Body,
5=Right Uppercut to the Body,
6=Left Hook to the Head,
7=Right Hook to the Body,
8=Left Hook to the Body,
9=Right Uppercut to the Chin,
10=Left Uppercut to the Chin,
11=Straight Left to the Chest,
12=Straight Right Jab to the Mid-section.

* * * * *